US009633826B1

(12) United States Patent
Nakano et al.

(10) Patent No.: US 9,633,826 B1
(45) Date of Patent: Apr. 25, 2017

(54) MASS SPECTROMETER WITH MOVABLE IONIZATION CHAMBER

(71) Applicant: SHIMADZU CORPORATION, Kyoto-shi, Kyoto (JP)

(72) Inventors: Tomohito Nakano, Kyoto (JP); Yusuke Sakagoshi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 15/070,284

(22) Filed: Mar. 15, 2016

(51) Int. Cl.
*H01J 49/04* (2006.01)
*H01J 49/10* (2006.01)

(52) U.S. Cl.
CPC ..... *H01J 49/04* (2013.01); *H01J 49/10* (2013.01); *H01J 49/0495* (2013.01)

(58) Field of Classification Search
CPC ..... G01N 30/6004; G01N 30/7233; G01N 30/7266; G01N 30/20; G01N 35/1097; H01R 13/6315; H01R 24/68; H01J 49/04; H01J 49/0495; H01J 49/0422
See application file for complete search history.

(56) References Cited

U.S. PATENT DOCUMENTS 5,753,910 A * 5/1998 Gourley ..... H01J 49/24 250/281
6,809,312 B1 * 10/2004 Park ..... H01J 49/24 250/281
8,927,929 B1 * 1/2015 Nakano ..... H01J 49/24 250/281
2001/0050336 A1 * 12/2001 Fukuda ..... H01J 49/0445 250/288
2004/0183010 A1 * 9/2004 Reilly ..... H01J 49/0418 250/288

FOREIGN PATENT DOCUMENTS

JP 2001-343363 A 12/2001

* cited by examiner

*Primary Examiner* — Brooke Purinton
(74) *Attorney, Agent, or Firm* — Sughrue Mion, PLLC

(57) ABSTRACT

The ionization chamber of the mass spectrometer is movable between the maintenance position for performing maintenance of the mass spectrometer unit and the analysis position for performing sample analysis, using a shielding plate synchronized with the motion of the ionization chamber where the shielding plate closes part of the aperture of the predetermined region when the ionization chamber is in the analysis position, whereas the shielding plate opens part of the aperture of the predetermined region when the ionization chamber is in the maintenance position so that connection tubes may pass through the part of the aperture of the predetermined region.

4 Claims, 5 Drawing Sheets

MASS SPECTROMETER WITH MOVABLE IONIZATION CHAMBER

TECHNICAL FIELD

The present invention relates to a mass spectrometer that has an ionization chamber, and more specifically, it relates to a liquid chromatography mass spectrometer comprising an ionization chamber that ionizes a liquid sample eluted from a liquid chromatography unit, and a mass spectrometer unit to which the ion chamber supplies ions.

BACKGROUND ART

A liquid chromatography mass spectrometer (LC/MS) comprises a liquid chromatography unit (an LC unit) that separates a liquid sample into components and elutes them, an ion chamber (an interface unit) that ionizes the sample components eluted from the LC unit, and a mass spectrometer unit (an MS unit) that detects the ions introduced from the ion chamber. There are various ionization methods used in the ionization chamber, including the Atmospheric Chemical Ionization (APCI) method, and the Electro Spray Ionization (ESI) method.

In an actual example of the APCI method, the tip of a nozzle connected to an end of column of the LC unit is oriented into the ionization chamber, and the front end of the tip of the nozzle has a needle electrode. For ionization, the needle electrode generates corona discharge to generate carrier gas ions (buffer ions) which chemically react with mist of a heated sample droplet in the nozzle. In the ESI method, the tip of a nozzle connected to an end of column of the LC unit is oriented into the ionization chamber, and there is approximately 5 kV of high voltage applied at the tip of the nozzle to generate a strong non-uniform electric field. The electric field separates electric charges of a liquid sample, and the Coulomb force makes the liquid sample mist. As a result, the solvent of the liquid sample evaporates by contacting with surrounding air, generating an ion gas.

Because the APCI and ESI methods ionize liquid samples at near-atmospheric pressure, in order to hold a certain pressure difference between the ion chamber at a high pressure (i.e., near atmospheric pressure) and the MS unit at very low pressure (i.e., in a high vacuum state), there is an intermediate chamber configured between the ionization chamber and the MS unit for gradual increase of the degree of vacuum (for example, refer to Patent Article 1).

FIG. 8 depicts a schematic diagram of an example of liquid chromatography mass spectrometer using the ESI method, and FIG. 9 is a perspective view of the liquid chromatography mass spectrometer shown in FIG. 8.

The liquid chromatography mass spectrometer comprises an ionization chamber 200, a mass spectrometer unit 50, a control chamber 16, and a housing unit 170.

There is a triangular shaped aluminum chamber 210 in the ionization chamber 200, and the chamber 210 has an top surface 210*a*, a first side surface, a second side surface, a third side surface, and a bottom surface. There is a circular aperture at the center of the first side surface, and the first side surface is air-tightly attached to the front surface of a first intermediate chamber 12 through a rubber O-ring around the aperture (not shown in the figures). There is a spray (part of ionization chamber) 15 attached on the top surface 210*a* of the chamber 210.

The control chamber 160 is located beneath the ionization chamber 200, having a rectangular control box of size 22 cm×48 cm×24 cm, and there is a rectangular aperture 161*a* of size 6 cm×10 cm formed on the top surface of the control box 161. There are a power supply 66 and a nebulized gas supply 65 configured in the control box 161. And, a cable connected to the power supply 66 connects to a heater and a temperature sensor through the aperture 161*a*. A tube 64 connected with the nebulized gas supply 65 connects to the spray 15 through the aperture 161*a*.

A liquid sample decomposed in the LC unit is supplied to the spray 15 through the tube 155. The nebulized gas source 65 supplies a nebulized gas (nitrogen gas) to the spray 15 through a tube (a connection pipe) 64 of diameter 0.3 cm. As a result, the liquid sample and the nebulized gas are guided into the spray 15 and spayed therefrom.

At the same time, although not shown in the figures, a high voltage power supply applies high voltage of 5 kV to a cable that is connected with the tip of the spray nozzle. For heating, the power supply 66 provides voltages to the heater (part of ionization chamber) and the temperature sensor (part of ionization chamber) through, e.g., a cable (a connecting tube) 67 of diameter 0.5 cm.

The spray 15 shown in FIG. 8 is used for the ESI method, which is generally detachable from/to the chamber 210, and if an APCI spray is preferably used, the ESI spay 15 may be detached and then the one for the APCI that has an integrated discharging needle electrode may be attached to the chamber 210.

In the mass spectrometer unit 50, there are a first intermediate chamber (a vacuum introduction unit) 12 adjacent to the ionization chamber 200, a second intermediate chamber 13 adjacent to the first intermediate chamber 12, and mass spectrometer chamber (the MS unit) 14 adjacent to the second intermediate chamber, each of which is separated by a partition but successively configured.

The first intermediate chamber 12 has rectangular aluminum housing 90 of size 15 cm×11 cm×60 cm, and there is a first ion lens 21 in the housing 90, whereas there is an exhaust 31 on the bottom surface of the housing 90 for evaluation using an oil rotary pomp (RP).

There is a heater block 20 that has a built-in temperature adjustment mechanism (not shown) on the front surface of the housing 90, and a circular solvent removing tube 19 (of the outer diameter 1.6 mm and the inner diameter 0.5 mm) is configured in the heart block 20. The solvent removing tube 19 connects the interiors of the chamber 210 and the housing 90. The solvent removing tube 19 has a capability of accelerating solvent removal and ionization due to heating and collisions when ions and minute liquid sample droplets, sprayed from the spray 15, upon passing through the solvent removal tube.

On the partition between the first intermediate chamber 12 and the second intermediate chamber 13, there is a skimmer 22 formed having an orifice though which the interiors of the housing 90 and the second intermediate chamber 13 are connected.

Inside the second chamber 13, there is an octupole 23 and a focus lens 24, and on the bottom surface of the second intermediate chamber 13, there is an exhaust 32 for vacuum evacuation using a turbo molecular pomp (TMP). On the partition between the second intermediate chamber 13 and the mass spectrometer chamber 14, there is an inlet lens 25 formed having an orifice through which the interiors of the second intermediate chamber and the mass spectrometer chamber 14 are connected.

In the mass spectrometer chamber 14, there are a first quadruple 16, a second quadruple 17, and a detector 18, and on the bottom surface of the mass spectrometer chamber 14, there is an exhaust 33 for vacuum evacuation using a turbo molecular pomp (TMP).

In such as liquid chromatography mass spectrometer, ions generated by the ionization chamber 200 are sent to the mass spectrometer chamber 14, successively through the solvent removing tube 19, the first ion lens 21 in the housing 90 of the first intermediate chamber 12, the skimmer 22, the octupole 23 and the focus lens 24 in the second intermediate chamber 13, and the inlet lens 25 in this order, wherein the quadruples 16 and 17 expel ions not required for detecting specific ions with the detector 18.

Because the aforementioned liquid chromatography mass spectrometer requires maintenance of the first ion lens 21 and other members, the ionization chamber 200 is configured as a single unit so that the ionization chamber 200 may switch between a maintenance position and an analysis position. For example, the ionization chamber 200 uses a hinge (not shown) to rotate around a vertical axis between the first side surface and the front surface of the first intermediate chamber 12 by approximately 90°. With this configuration, an observer may place the ionization chamber 200 in the maintenance position for performing maintenance on the first ion lens 21 and other members, and, in turn, place the ionization chamber 200 in the analysis position for performing analysis.

In order to improve the appearance by concealing the interior of the control box 161, or as a countermeasure against water-splashing test of the Low Voltage Directive, the housing unit 170 is configured. The housing case 170 has a rectangle case 171 of size 16 cm×20 cm×27 cm, and a cover 172 that is rotatable relative to the case 171. The tube 64, the cable 67, and the aperture 161*a* are configured in the case 171. With such configuration, for conducting analysis, after removing the spray 15, the ionization chamber 200 is inserted while the cable 67 and the tube 64 are inserted into the case 171.

PRIOR ART REFERENCE

Patent Article

[Patent Article 1] Japanese Patent Publication No. 2001-343363

SUMMARY OF THE INVENTION

Problems to be Solved by the Invention

However, because the aforementioned liquid chromatography mass spectrometer requires the housing unit 170, it has a disadvantage of additional cost for forming the housing unit 170.

The present invention has a purpose of providing a mass spectrometer that may conceal the interior of the control housing when performing analysis without forming the housing unit by making the ionization chamber movable between the maintenance position and the analysis position.

Means for Solving the Problem

In order to solve the aforementioned technological issue, the mass spectrometer of the present invention comprises an ionization chamber that has a part for ionizing a sample, a mass spectrometer unit to which ions are introduced from the ionization chamber, and a control chamber that controls part of the ionization chamber, where the control chamber has a control chamber case, a power supply and/or a gas source configured in the control chamber case, and connecting tubes with which the power supply and/or the gas source are connected, whereas the connecting tubes are connected with part of the ionization chamber through an aperture in a predetermined region; the ionization chamber is movable between a maintenance position for performing maintenance of the mass spectrometer unit and the analysis position for conducting analysis of the sample, and there is a shielding plate linked with the motion of the ionization chamber, which closes part of the aperture of the predetermined region when the ionization chamber is in the analysis position, and opens part of the aperture of the predetermined region when the ionization chamber is in the maintenance position so that the connecting tubes may open to the part of the aperture of the predetermined region.

Here, the "predetermined region" is an area having a size allowing the connecting tubes to move in sync with the ionization chamber travels between the maintenance position and the analysis position, which is determined by orbital calculation and other design tools. The "part of the aperture of the predetermined region" preferably has position and size that conceal the interior of the control chamber case from an observer when the ionization chamber is in the analysis position.

Effects of the Invention

As described above, according to the mass spectrometer of the present invention, when the ionization chamber is in the analysis position, the shielding plate closes part of the aperture of the predetermined region. When the ionization chamber is in the maintenance position, the shielding plate opens part of the aperture of the predetermined region so that the connecting tubes pass through the part of the aperture. Thus, by making the ionization chamber movable between the maintenance position and the analysis position, it is possible to conceal the interior of the control chamber case without installing a housing unit.

Means for Solving Other Problems and its Effects

In the mass spectrometer of the present invention, the ionization chamber is a rectangular shape that has the back surface connected with the mass spectrometer unit, the front surface, the right side surface, and the left side surface, where the ionization chamber may be rotatable about a vertical axis which is a side edge line of the back side surface.

The mass spectrometer of the present invention may form the control chamber underneath the ionization chamber, and the aperture on the top surface of the control chamber case.

Furthermore, the mass spectrometer of the present invention may have a horizontally laid plate as the shielding plate, a rotational axis for the rotational motion of the ionization chamber, and a protrusion that makes a sliding motion for the control chamber case.

DETAILED DESCRIPTION OF THE EXEMPLARY EMBODIMENTS

Referring to the figures herein, an embodiment of the present invention is explained hereinafter. Needless to say, the present invention is not limited these embodiments, and various modes may be included within the scope of the present invention.

Figure 1:
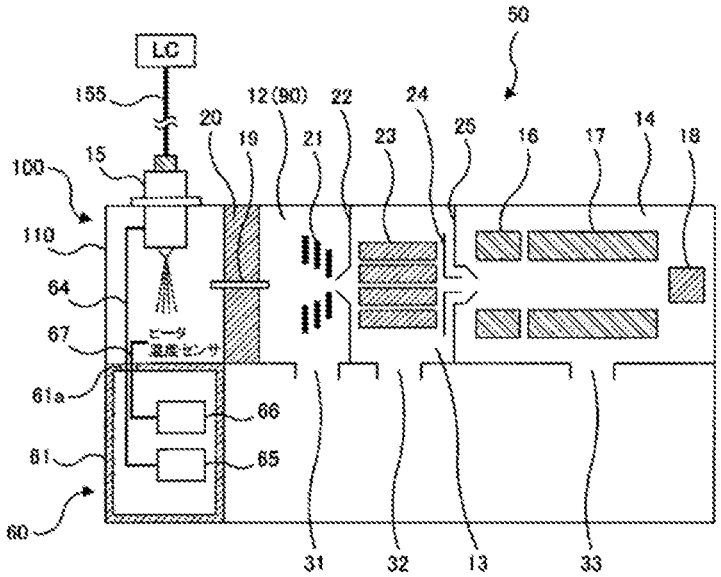
FIG. 1 A schematic diagram of a liquid chromatography mass spectrometer using the ESI method as an example of the present invention.
Figure 2:
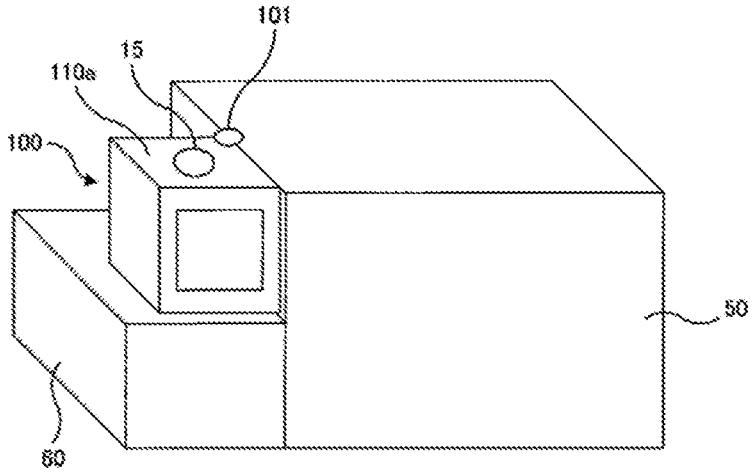
FIG. 2 A perspective view of the liquid chromatography mass spectrometer as shown in FIG. 1.
Figure 3:
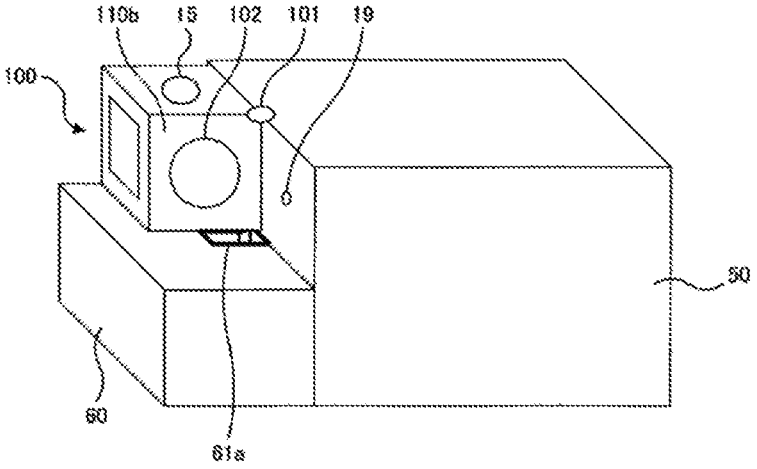
FIG. 3 A perspective view of the liquid chromatography mass spectrometer as shown in FIG. 1.
Figure 4:
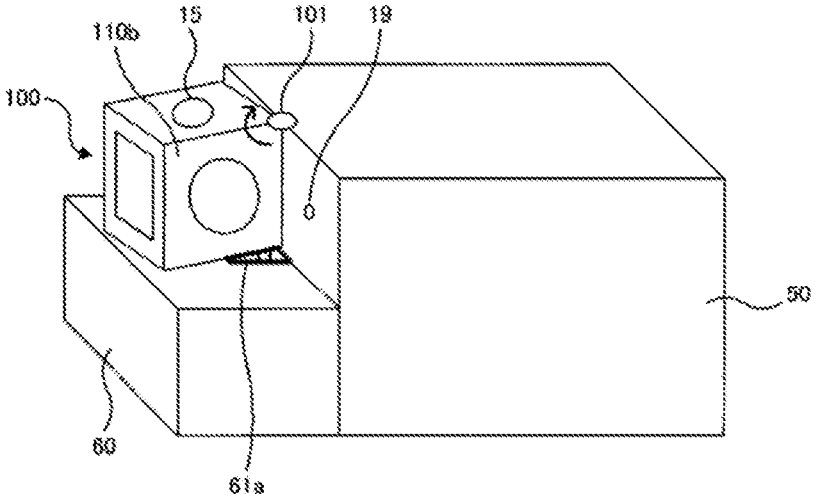
FIG. 4 A perspective view of the liquid chromatography mass spectrometer as shown in FIG. 1.
Figure 5:
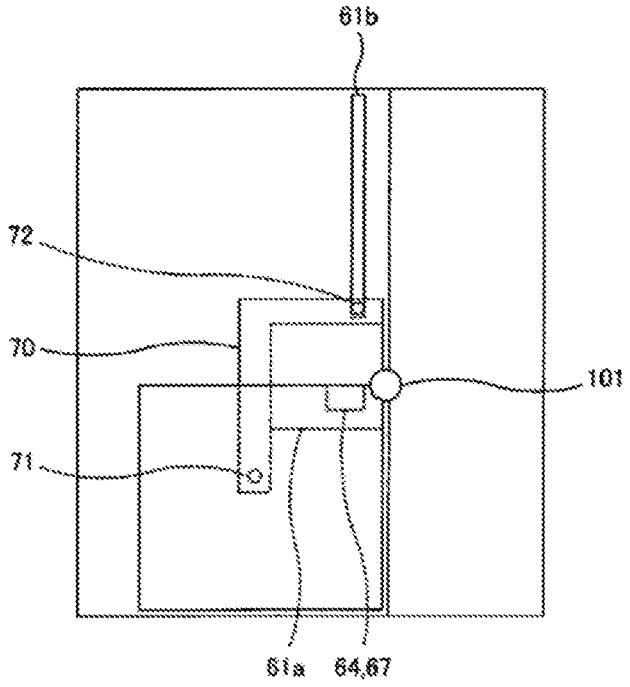
FIG. 5 A plan view the liquid chromatography mass spectrometer as shown in FIG. 1.
Figure 6:
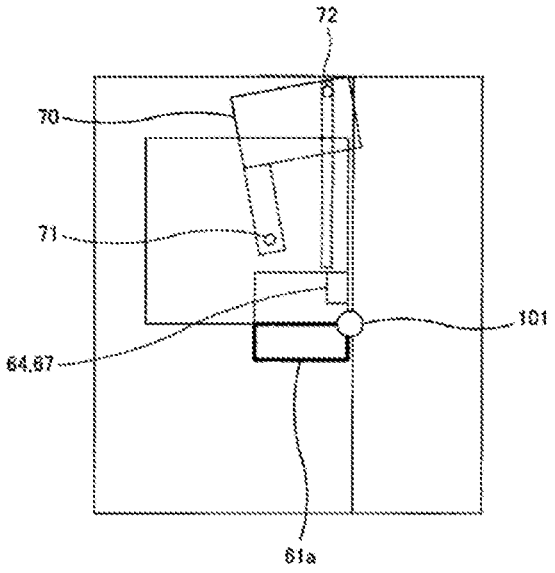
FIG. 6 A plan view the liquid chromatography mass spectrometer as shown in FIG. 1.
Figure 7:
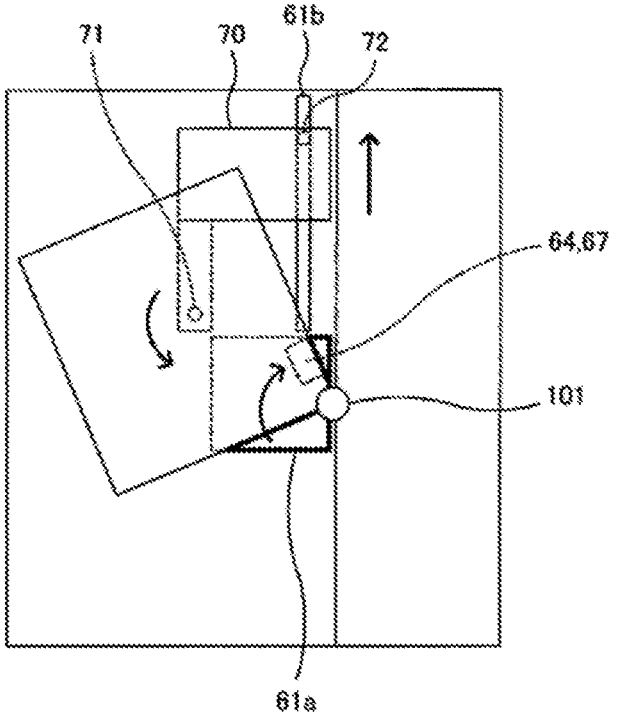
FIG. 7 A plan view the liquid chromatography mass spectrometer as shown in FIG. 1.
Figure 8:
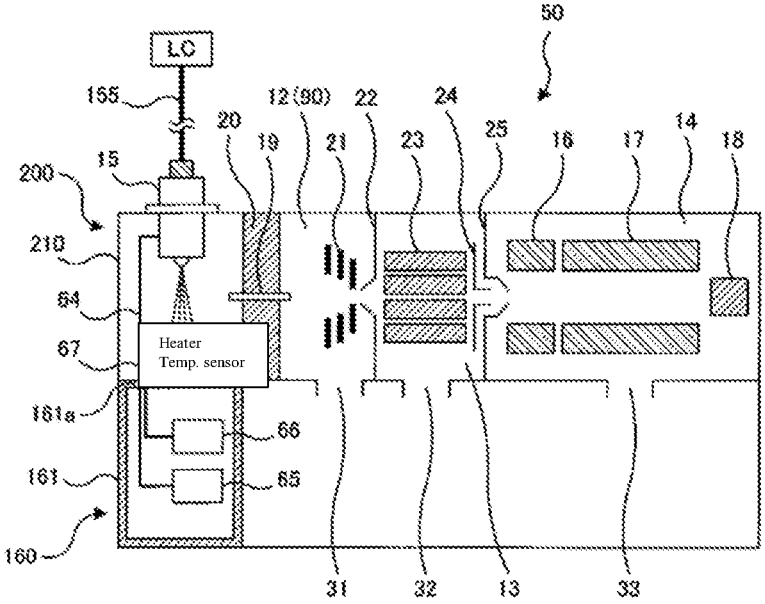
FIG. 8 A schematic diagram of an example of a general liquid chromatography mass spectrometer using the ESI method.
Figure 9:
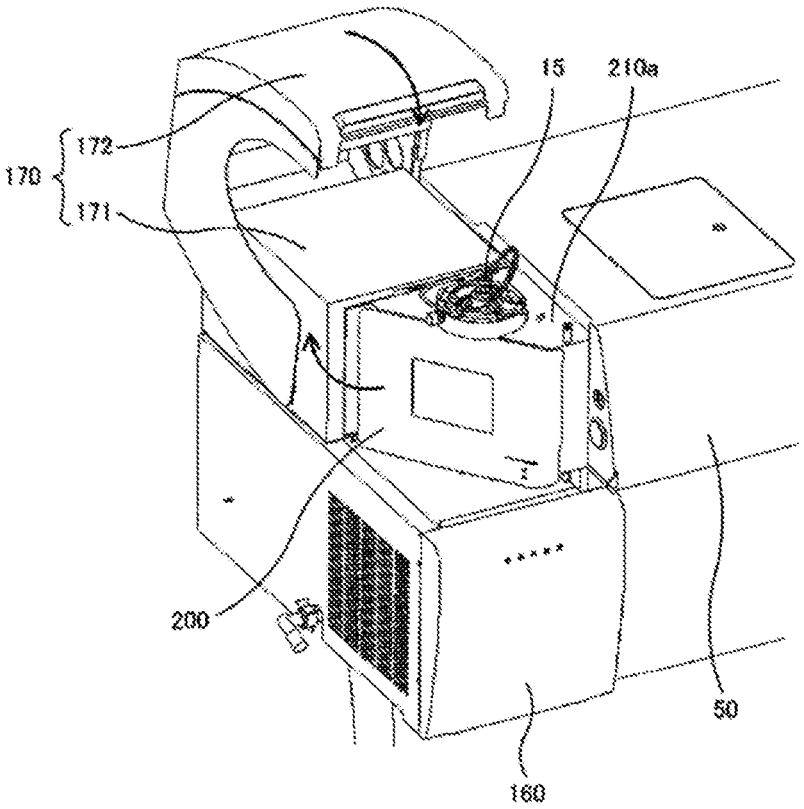
FIG. 9 A perspective view of the liquid chromatography mass spectrometer as shown in FIG. 8.

FIG. 1 shows a schematic diagram of a liquid chromatography mass spectrometer using the ESI method as an embodiment of the present invention. FIGS. 2 to 4 depict perspective views of the liquid chromatography mass spectrometer shown in FIG. 1, FIGS. 5 to 7 illustrate plan views of the liquid chromatography mass spectrometer shown in FIG. 1. FIGS. 2 and 5 show the ionization chamber in the analysis position, FIGS. 3 and 6 show the ionization chamber in the maintenance position, and FIGS. 4 and 7 show the ionization chamber while moving. For a same spectrometer as the aforementioned liquid chromatography mass spectrometer of the prior art, the same reference numerals are used.

The liquid chromatography mass spectrometer comprises an ionization chamber 100, a mass spectrometer unit 50, a control chamber 60, and a shutter plate (a shielding plate) 70.

The ionization chamber 100 comprises a rectangular aluminum chamber 110 of size 13 cm×13 cm×12 cm, and the chamber 110 has top surface 110*a*, back surface 110*b*, front surface, right side surface, left side surface, and bottom surface. There is a circular aperture 102 formed at the center area of the back surface 110*b*, and the circumference of the aperture 102 of the back surface 110*b* is air-tightly connected with the front surface of a first intermediate chamber 12 through a rubber O-ring (not shown). There is a spray (part of ionization chamber) 15 attached to the top surface of the chamber 110.

The control chamber 60 comprises a control chamber case 61 which is a rectangle of size 22 cm×48 cm×24 cm and configured underneath the ionization chamber 100, and there are a square aperture 61*a* of size 14 cm×10 cm and a slide groove 61*b* formed on the top surface of the control chamber case 61. There are a power supply 66 and a nebulized gas source 61*b* configured in the control chamber box 61. A cable 67 connected with the power supply 66 connects to a heater and a temperature sensor through the aperture 61*a*. A tube 54 connected with the nebulized gas source 65 connects to the spray 15 through the aperture 61*a*.

A liquid sample decomposed into components in the LC unit is supplied to the spray 15 through a connection tube 155. The nebulized gas source 65 also supplies a nebulized gas (nitrogen gas) to the spray 15 through a tube (connection pipe) 64 of diameter, e.g., 0.3 cm. As a result, the liquid sample and the nebulized gas are guided to the spray 15 and sprayed therefrom.

Although not shown in the figures, there is a cable of diameter, e.g., 0.5 cm connected with the tip of spray nozzle for applying a high voltage of 5 kV to the tip to perform ionization. There is a cable (connecting tube) 67 of diameter, e.g., 0.5 cm connected with the power supply 66 in order to apply voltages to the heater (part of ionization chamber) and the temperature sensor (part of ionization chamber) for heating.

The ionization chamber 100 is movable between the maintenance position and the analysis position. Actually, the ionization chamber 100 uses a hinge 101 to rotate around a vertical axis on the front surface of the first intermediate chamber 12 by approximately 90°. With this configuration, an observer may place the ionization chamber 100 in the maintenance position for performing maintenance on a first ion lens 21 and other members, and place the ionization chamber 100 in the analysis position for performing analysis.

On the bottom surface of the chamber 110, there are connection ports for attaching the connecting tube 64 and the cable 67. These connection ports are preferably formed neat the hinge 101 on the bottom surface of the chamber 110.

A shutter plate (shielding plate) 70 is an L-shaped plate that is configured between the bottom surface of the chamber 110 and the top surface of the control chamber case 61. On the upper surface of the shutter plate 70, a cylindrical rotational axis 71 is formed, which is inserted into a cylindrical hole formed on the bottom surface of the chamber 110 while maintaining rotational flexibility. On the lower surface of the shutter plate 70, a cylindrical pin (protrusion) 72 is formed, which is movably inserted into the slide groove 61*b* of a rectangular shape having the longer side along the crosswise direction (0.6 cm×13 cm) formed on the top surface of the control chamber case 61.

The analysis mode (for ordinary use) and the maintenance mode (for maintenance of the mass spectrometer unit) of the liquid chromatography mass spectrometer of the present invention are explained hereinafter.

(1) Analysis Mode (Refer to FIGS. 2 and 5)

The ionization chamber 100 is in the analysis position, and the circumference of the aperture 102 on the back surface 110*b* is air-tightly connected with the front surface of the first intermediate chamber 12. At this time, the cable 63 and the connection tube 64 are guided into the interior of the ionization chamber 100 through the right side area of the aperture 61 underneath the ionization chamber. The shutter plate 70 is configured to close the left side area (in part) of the aperture 61*a*. In other words, above the right side area of the aperture 61*a*, there is the ionization chamber 100, whereas above the left side area of the aperture 61*a*, there is the shutter plate 70, and hence an observer is unable to see the interior of the control chamber case 61.

(2) From Analysis Mode to Maintenance Mode (Refer to FIGS. 4 and 7)

As the ionization chamber 100 rotates to shift from the analysis position to the maintenance position, the front surface of the first intermediate chamber 12 is being opened. At this time, the shutter plate 70 rotates around the rotational axis 71 relative to the ionization chamber 100, and at the same time, the pin 72 slides from the right end to the left end of the slide groove 61*b* for opening the left side area (in part) of the aperture 61*a*. The cable 67 and the connection tube 64 move from the left side area to the right side area of the aperture 61*a*.

(3) Maintenance Mode (Refer to FIGS. 3 and 6)

The ionization chamber 100 is in the maintenance position, and the front surface of the first intermediate chamber 12 is opened. At this time, because the shutter plate 70 is configured to open the left side area (in part) of the aperture 61*a*, the cable 67 and the connection tube 64 are guided into the interior of the chamber 110 through the left side area of the aperture. Because there is nothing above the right side area of the aperture 61*a*, an observer may observe the interior of the control chamber case 61.

As explained above, according to the liquid chromatography mass spectrometer of the present invention, when the ionization chamber 100 is located in the analysis position, the shutter plate 70 closes the left side area (in part) of the aperture 61*a*. When the ionization chamber 100 is located in the maintenance position, the shutter plate 70 opens the left side area (in part) of the aperture 61*a* so that the cable 67 and the connection tube 64 may pass through the left side area (in part) of the aperture 61. Thus, the ionization chamber 100 movable between the maintenance position and the analysis position may conceal the interior of the control chamber case 61 when conducting analysis without installing a housing unit.

INDUSTRIAL FIELD OF APPLICATION

The present invention may be used in a mass spectrometer that has an ionization chamber.

EXPLANATION OF REFERENCE NUMERALS

15: Spray (as part of ionization unit)
19: Solvent removable tube
50: Mass spectrometer
60: Control chamber
61: Control chamber case
61*a*: Aperture
64: Connection tube (connection pipe)
65: Gas source
67: Cable (connection pipe)
70: Shutter plate (shielding plate)
100: Ionization chamber

What is claimed:

1. A mass spectrometer comprises:

an ionization chamber that has a part for ionizing a sample, a mass spectrometer unit to which ions are introduced from the ionization chamber, and a control chamber that controls part of the ionization chamber, where the control chamber has a control chamber case, a power supply and/or a gas source configured in the control chamber case, and connecting tubes with which the power supply and/or the gas source are connected, whereas the connecting tubes are connected with part of the ionization chamber through an aperture in a predetermined region; the ionization chamber is movable between a maintenance position for performing maintenance of the mass spectrometer unit and the analysis position for conducting analysis of the sample, and there is a shielding plate linked with the motion of the ionization chamber, which closes part of the aperture of the predetermined region when the ionization chamber is in the analysis position, and opens part of the aperture of the predetermined region when the ionization chamber is in the maintenance position, so that the connecting tubes may open to the part of the aperture of the predetermined region.

2. The mass spectrometer of claim 1, wherein the ionization chamber is a rectangular shape, having the back surface connected with the mass spectrometer unit, the front surface, the right side surface, and the left side surface, where the ionization chamber may be rotatable about a vertical axis which is a side edge line of the back side surface.

3. The mass spectrometer of claim 1, wherein the control chamber is configured underneath the ionization chamber, and the aperture is formed on the top surface of the control chamber case.

4. The mass spectrometer of claim 1, wherein the shielding plate is a horizontally laid plate, having a rotational axis for the rotational motion of the ionization chamber and a protrusion that makes a sliding motion for the control chamber case.

* * * * *